United States Patent [19]

Sugiura et al.

[11] 4,299,714

[45] Nov. 10, 1981

[54] HYDROCARBON BASED CENTRAL SYSTEM FLUID COMPOSITION

[75] Inventors: Kensuke Sugiura; Mineo Kagaya, both of Kawasaki; Hiroyuki Aoki, Urawa; Takeitiro Takehara, Yokohama, all of Japan

[73] Assignees: Nippon Oil Company, Ltd.; Nissan Motor Co., Ltd., both of Japan

[21] Appl. No.: 175,041

[22] Filed: Aug. 4, 1980

[30] Foreign Application Priority Data

Aug. 6, 1979 [JP] Japan ..... 54/99400

[51] Int. Cl.[3] ..... C09K 5/00

[52] U.S. Cl. ..... 252/73; 585/7; 585/18

[58] Field of Search ..... 252/73; 585/7, 10, 18

[56] References Cited

U.S. PATENT DOCUMENTS 3,763,244 10/1973 Shubkin ..... 585/18

4,031,020 6/1977 Sugiura et al. ..... 252/73 X 4,032,591 6/1977 Cupples et al. ..... 585/18 X 4,085,056 4/1978 Schenach ..... 585/10 X

*Primary Examiner*—Mayer Weinblatt

*Attorney, Agent, or Firm*—Wenderoth, Lind & Ponack

[57] ABSTRACT

In a central system fluid composition comprising (1) 70 to 95% by weight of a hydrocarbon base oil and (2) 5 to 30% by weight of a viscosity index improver, the improvement wherein said hydrocarbon base oil (1) comprises (a) 25% by weight to less than 50% by weight, based on the weight of the hydrocarbon base oil (1), of an oligomer of 1-decene having an average molecular weight of 200 to 600 and (b) more than 50% by weight to 75% by weight of a petroleum lubricating oil fraction, and said viscosity index improver (2) is a polymethacrylate having a viscosity average molecular weight of 10,000 to 700,000 obtained by polymerizing at least one ester of a saturated monohydric aliphatic alcohol having 1 to 18 carbon atoms with methacrylic acid.

6 Claims, No Drawings

HYDROCARBON BASED CENTRAL SYSTEM FLUID COMPOSITION

BACKGROUND OF THE INVENTION

This invention relates to a central system fluid composition.

A central vehicle hydraulic system, or simply a central system, denotes a system whereby hydraulic devices are mounted on a motor vehicle to actuate a power steering device, a brake, an automatic transmission device, a hydraulic suspension device, a windshield wiper, a seat actuator, a wind actuator, etc. through a single hydraulic source using a single kind of oil. A fluid used in this system is called a central system fluid.

The properties required of the central system fluid are regulated in U.S.A. by SAE 71R1 Standards (for mineral oils) and SAE 71R2 Standards (for synthetic oils). These standards were set down on the basis of the properties required of both a power steering fluid and a brake fluid. These standards are diverse and severe and specifically include the following.

1. They should have excellent flowability at low temperatures.
2. They should have excellent shear stability.
3. They should be operable over a wide temperature range.
4. They should have high boiling and flash points.
5. They should not form precipitates or condensates at low temperatures.
6. They should have a reduced tendency to bubbling.
7. They should have excellent lubricity and oxidation stability.
8. They should not corrode the metallic portions of a hydraulic system nor excessively swell the rubber portions thereof.

The present inventors already suggested a fluid which is acceptable by the SAE 71R1 Standards, and disclosed it in U.S. Pat. No. 4,031,020 as a hydraulic composition consisting essentially of at least one hydrocarbon base oil selected from the group consisting of (A) polybutene, (B) a homopolymer or copolymer of an alphaolefin having 2 to 12 carbon atoms and (C) a nuclearly hydrogenated product of an aromatic hydrocarbon, and at least one viscosity index improver selected from (1) polymethacrylates and (2) polyolefins.

In recent years, the central system fluid has also been required to have excellent performance at high temperatures, such as high flash and initial boiling points and a reduced loss of weight by evaporation, from the standpoint of safety and in view of a temperature rise within the engine room resulting from measures taken to control motor vehicle exhausts. Moreover, the compatibility of the central system fluid with rubber material used in the central hydraulic system has been regarded as more important than before, and in addition to the aforesaid SAE Standards, the central system fluid is also required to have an aniline point within a specified desirable range. The properties of the central system fluid which have been newly required are tabulated

| | Newly required properties | SAE 71R1 Standards | SAE 71R2 Standards |
|---|---|---|---|
| 1. Viscosity cSt (100° C.) | above 6.3 | — | — |
| 2. Low temperature viscosity cSt (−40° C.) | below 2000 | below 2000 | below 1800 |
| 3. Flash point (°C.) | above 140 | above 107.2 | above 96.1 |
| 4. Initial boiling point (°C.) | above 240 | above 204.4 | above 204.4 |
| 5. Aniline point (°C.) | 80–100 | — | — |
| 6. Weight loss by evaporation (100° C. × 48 hrs) | below 15% by weight | — | — |

The aforesaid SAE Standards themselves are very severe, and to the best of the knowledge of the present Applicants, except the hydraulic composition disclosed in the above-cited U.S. Pat. No. 4,031,020, there has been scarcely any fluid composition which fully meets the SAE standards. It has been considered extremely difficult therefore to provide a fluid which meets the above tabulated various properties in addition to the SAE Standards.

SUMMARY OF THE INVENTION

It is an object of this invention to provide a central system fluid composition which meets the SAE Standards and also has the high temperature properties tabulated above such as the flash point, initial boiling point and evaporation loss and good compatibility with rubber materials.

According to this invention, there is provided a central system fluid composition comprising (1) 70 to 95% by weight of a hydrocarbon base oil and (2) 5 to 30% by weight of a viscosity index improver, characterized in that said hydrocarbon base oil (1) comprises (a) 25% by weight to less than 50% by weight, based on the weight of the hydrocarbon base oil (1), of an oligomer of 1-decene having an average molecular weight of 200 to 600 and (b) more than 50% by weight to 75% by weight of a petroleum lubricating oil fraction, and said viscosity index improver (2) is a polymethacrylate having a viscosity average molecular weight of 10,000 to 700,000 obtained by polymerizing at least one ester of a saturated monohydric aliphatic alcohol having 1 to 18 carbon atoms with methacrylic acid.

DETAILED DESCRIPTION OF THE INVENTION

The fluid composition of this invention comprises (1) 70 to 95% by weight of a hydrocarbon base oil and (2) 5 to 30% by weight of a viscosity index improver. If desired, this composition may further comprise (3) 0.1 to 10% by weight of an additive.

(1) Hydrocarbon Base Oil

The hydrocarbon base oil (1), as used in this invention, comprises (a) 25% by weight to less than 50% by weight, based on the weight of the hydrocarbon base oil (1), of an oligomer of 1-decene having an average molecular weight of 200 to 600, and (b) more than 50% to 75% by weight, based on the weight of the hydrocarbon base oil (1), of a petroleum lubricating oil fraction.

(1-a) The oligomer of 1-decene that can be used in this invention has an average molecular weight of 200 to 600. The 1-decene oligomer includes a dimer, trimer or tetramer, preferably a dimer, of 1-decene, or an oligomeric mixture containing these oligomers as a main ingredient. Oligomers of 1-decene having a lower average molecular weight have a low flash point, and those having a higher average molecular weight have too high a viscosity. The oligomers of 1-decene used in this invention have a viscosity of not more than 4.0 cSt (100° C.), preferably not more than 2.0 cSt (100° C.). The method of preparing these oligomers is well known to those skilled in the art. For example, the 1-decene oligomer can be prepared by polymerizing 1-decene cationically using an aluminum chloride/aluminum bromide catalyst, an aluminum bromide/hydrogen bromide catalyst, a boron fluoride/alcohol catalyst, or an aluminum chloride/ester catalyst, radical polymerization of 1-decene with heat or peroxides, or by polymerizing 1-decene in the presence of a Ziegler-type catalyst.

(1-b) Usable petroleum lubricating oil fractions are those obtained by the distillation, purification, etc. of petroleums and having a viscosity of not more than 4.0 cSt (100° C.), a viscosity index of at least 70 and a pour point of not more than −10° C.

The mixing ratio between the above two components in the hydrocarbon base oil (1) in this invention is such that based on the weight of the hydrocarbon base oil (1), the proportion of the component (a) is at least 25%) by weight but below 50% by weight, preferably at least 30% by weight but below 50% by weight, and the proportion of the component (b) is more than 50% by weight and up to 75% by weight, preferably more than 50% by weight and up to 70% by weight.

In addition to the above two components, (c) polybutene may be used as the hydrocarbon base oil (1).

(1-c) Polybutene that can be used in this invention has an average molecular weight of 100 to 500, preferably 150 to 300. If the average molecular weight is less than 100, the flash point of the hydrocarbon oil becomes low. If the average molecular weight exceeds 500, the viscosity of the polybutene becomes too high. The viscosity of the polybutene used in this invention is not more than 2.0 cSt (100° C.). If the viscosity is within this range, higher-boiling polybutene or hydrogenated polybutene may be mixed in a minor amount. The method of production of polybutene is well known to those skilled in the art. If can be produced, for example, by polymerizing a butane-butene fraction formed by cracking of a petroleum fraction, for example, at −30° to +30° C. using a Friedel-Crafts catalyst such as aluminum chloride, magnesium chloride, boron fluoride or titanium tetrachloride, or complex compounds of these and optionally in the presence of a promotor such as an organic halide or hydrochloric acid.

When the polybutene is used, the mixing ratio between the three components in the hydrocarbon base oil is such that based on the weight of the hydrocarbon base oil, the proportion of the component (a) is 25 to less than 50% by weight, preferably 30 to less than 50% by weight, the proportion of the component (b) is more than 50% and up to 75% by weight, preferably more than 50% and up to 70% by weight, and the proportion of the component (c) is not more than 20% by weight.

(2) Viscosity Index Improver

The viscosity index improver used in this invention is a polymethacrylate having a viscosity average molecular weight of 10,000 to 700,000, preferably 50,000 to 200,000 obtained by polymerizing at least one ester formed between a saturated monohydric aliphatic alcohol having 1 to 18 carbon atoms and methacrylic acid. If the viscosity average molecular weight of the polymethacrylate is less than 10,000, the addition of the polymethacrylate in an amount necessary for obtaining a sufficient viscosity in a high temperature region results in too high a viscosity in a low temperature region. If the viscosity molecular weight exceeds 700,000, the resulting composition does not have sufficient shear stability and has a decreased viscosity in a high temperature region.

The amount of the viscosity index improver is 5. to 30% by weight, preferably 7 to 20% by weight, based on the fluid composition. If the amount of the viscosity index improver is less than 5% by weight, the viscosity of the fluid composition in a high temperature region is not sufficient. If, on the other hand, its amount exceeds 30% by weight, the viscosity of the fluid composition in a low temperature range becomes too high.

(3) Additive

In addition to the essential components, i.e. (1) the hydrocarbon base oil and the viscosity index improver (2), at least one additive selected from antioxidants oiling agents, abrasion resisting agents, cleansing dispersants, anti-foamers, metal inactivating agents, etc. may be added. Details of these additives are described, for example, in a Japanese-language publication entitled "Additives for Petroleum Products", edited by Toshio Sakurai (published by Saiwai Shobo, Japan, in 1974). Examples of preferred additives are described below.

Suitable antioxidants include alkylphenols, aromatic amines and metal dithiophosphates. Specific examples are 2,6-di-tert-butyl para-cresol, 2,6-di-tert-butyl phenol, phenyl-alpha-naphthylamine and zinc dialkyldithiophosphates. The amount of the antioxidant is generally not more than 0.1% by weight, preferably not more than 3.0% by weight, based on the weight of the fluid composition.

Suitable oiling agents include, for example, higher fatty acids such as oleic acid or stearic acid, higher alcohols such as oleyl alcohol, higher fatty acid esters, alkylamines, oils and fats, and sulfurized oils and fats. The amount of the oiling agent is preferably 0.5 to 6.0% by weight.

Suitable abrasion-resisting agents include metal dithiophosphates and phosphoric acid esters. The amount of the abrasion-resisting agent is 0.1 to 5% by weight based on the weight of the fluid composition.

Examples of the cleansing dispersants are neutral, basic or ultrabasic metal sulfonates, phenates and phosphonates, and ash-free type dispersants such as alkenylsuccimides, benzylamine and aminoamide. The amount of the dispersant is preferably 0.1 to 4.0% by weight based on the weight of the fluid composition.

Useful antifoamers are silicones and esters such as polymethacrylates. The amount of the antifoamer is preferably 0.002 to 0.05% by weight based on the weight of the fluid composition.

Benzotriazole is an example of the metal inactivating agent. The amount of the metal inactivating agent is preferably 0.005 to 0.5% by weight based on the weight of the fluid composition.

When two or more additives are used in combination, the total amount of these is preferably 0.1 to 10% by weight based on the weight of the fluid composition.

The central system fluid composition in accordance with this invention meets the SAE Standards disclosed in U.S. Pat. No. 4,031,020 and has better properties at high temperatures than fluids which meet these standards, and exhibits good compatibility with rubber materials. It can be used not only as a fluid for a central hydraulic system, but also as a fluid in other applications, such as a brake fluid, a power steering fluid, a shock absorber fluid, and an automatic power transmission oil.

The following Examples and Comparative Examples illustrate the present invention more specifically.

In Table 1, the compositions of Examples 1 to 7 are central system fluid compositions in accordance with this invention. The compositions of Comparative Examples 1 to 6 in Table 2 are given by way of comparison. In the tables, the proportions of components (1-a) to (1-c) are % by weight based on the hydrocarbon base oil (1), and the amounts of components (2) and (3) are shown by weight % based on the weight of the fluid composition.

The oils and additives used were as follows:

(1) Hydrocarbon base oil (1-a) Oligomer of 1-decene

A is an oligomer of 1-decene containing a dimer as a main ingredient and having an average molecular weight of 280.

(1-b) Petroleum lubricating oil fraction

B is a paraffinic mineral oil having a viscosity of 2.773 cSt, and C is a naphthenic mineral oil having a viscosity of 1.641 cSt (100° C.).

(1-c) Polybutene

D has an average molecular weight of 250.

(2) Viscosity index improver

Polymethacrylate E is a polymethacrylate having a viscosity average molecular weight of 143,000 obtained by polymerizing an ester of a mixture of saturated monohydric aliphatic alcohols having 1 to 18 carbon atoms and containing at least 60% by weight of n-dodecyl alcohol and methacrylic acid.

(3) Additives

An antioxidant F is 2,6-di-tert-butyl paracresol; an abrasion resisting agent H is a commercially available phosphorus-type abrasion resisting agent; an oiling agent I is an oil and fat; an oiling agent J is a fatty acid having 14 to 18 carbon atoms; a cleansing dispersant K is magnesium sulfonate; a cleansing dispersant L is polybutenyl succinimide; a cleansing dispersant M is aminoamide; a cleansing dispersant N is calcium sulfonate; an antifoamer P is silicone; and an antifoamer Q is an ester-type antifoamer.

The compositions of Examples 1 to 7 and Comparative Examples 1 to 6 were tested for the various properties shown below. The results are shown in Tables 1 and 2. The testing methods were as follows:

1. Viscosity

Measured at 100° C. in accordance with ASTM D-445. Preferred viscosities are at least 6.3 cSt.

2. Low temperature viscosity

Measured at −40° C. by a Brookfield method. Preferred low temperature viscosities are not more than 2000 cSt.

3. Flash point

Measured in accordance with ASTM D-92. Preferred flash points are at least 140° C.

4. Initial boiling point

Measured in accordance with ASTM D-158. Preferred initial boiling points are at least 240° C.

5. Aniline point

Measured in accordance with JIS K-2256. Preferred aniline points are 80° to 100° C.

6. Weight loss by evaporation

Measured after standing at 100° C. for 48 hours, in accordance with JIS K-2233. Preferably, the weight loss is not more than 15% by weight.

EXAMPLES 1 to 6

Example 1 covers a central system fluid composition of this invention composed of (1-a) an oligomer of 1-decene, (1-b) a petroleum lubricating oil fraction and (2) polymethacrylate. Examples 2 to 6 cover compositions prepared by adding various additives (3) to the aforesaid composition of this invention. All of these compositions showed satisfactory acceptable levels in the various tests conducted, and proved to be excellent central system fluids.

EXAMPLE 7

Example 7 covers a composition composed of (1-a) an oligomer of 1-decene, (1-b) a petroleum-type lubricating oil fraction, (1-c) polybutene, (2) polymethacrylate and (3) various additives. This composition showed satisfactory acceptable levels in the various tests conducted, and proved to be an excellent central system fluid.

Comparative Examples 1 to 6

Comparative Examples 1 to 2 cover fluid compositions containing only the petroleum lubricating oil fraction (1-b) as the hydrocarbon base oil. These compositions had too high a viscosity at low temperatures, and the composition of Comparative 2 had a low aniline content, and was not favorable for the purpose of this invention.

Comparative Example 3 covers a fluid composition containing only polybutene (1-c) as the hydrocarbon base oil. Its flash point and initial boiling point were not sufficient, and its weight loss by evaporation was large. Thus, this composition cannot be favorably used for the purpose of this invention.

Compositions shown in Comparative Examples 4 and 5 contain the oligomer of 1-decene (1-a) and the petroleum lubricant oil fraction (1-b) as the hydrocarbon base oil. Because the amount of the petroleum lubricating oil fraction was larger than the limit specified in this invention, the viscosity of the compositions at low temperature was too high, and these compositions cannot be favorably used for the purpose of this invention.

Comparative Example 6 covers a composition containing the oligomer of 1-decene (1-a) and the polybutene (1-c) as the hydrocarbon base oil. It had a low flash point and a low initial boiling point, and underwent a large weight loss by evaporation. Hence, it cannot be favorably used for the purpose of this invention.

TABLE 1

| Example | 1 | 2 | 3 | 4 | 5 | 6 | 7 |
|---|---|---|---|---|---|---|---|
| (1) Hydrocarbon base oil | | | | | | | |
| (a) Oligomer of 1-decene | A(49) | A(49) | A(49) | A(30) | A(35) | A(30) | A(30) |
| (b) Petroleum-type lubricating oil fraction | B(51) | B(51) | C(51) | B(30) C(40) | B(20) C(45) | B(25) C(45) | B(55) |
| (c) Polybutene | | | | | | | D(15) |
| (2) Viscosity index improver | | | | | | | |
| Polymethacrylate | E(13.5) | E(13.5) | E(15.0) | E(13.5) | E(14.0) | E(14.0) | E(13.5) |
| (3) Additive | | | | | | | |

TABLE 1-continued

| Example | 1 | 2 | 3 | 4 | 5 | 6 | 7 |
|---|---|---|---|---|---|---|---|
| Antioxidant | | F(0.8) | F(0.3) | F(0.3) | G(0.5) | G(0.5) | F(0.3) |
| Abrasion resisting agent | | H(3.0) | H(3.0) | H(3.0) | | | H(3.0) |
| Oiling agent | | I(2.0) | I(2.0) | I(2.0) | J(0.1) | J(0.1) | I(2.0) |
| Cleansing dispersant | | | | | K(1.0) | N(1.0) | |
| | | | | | L(1.0) | M(1.0) | |
| Antifoamer | | P(0.05) | P(0.05) | P(0.05) | P(0.05) | P(0.03) | P(0.05) |
| Test results | | | | | | | |
| 1. Viscosity cSt (100° C.) | 6.450 | 6.660 | 6.449 | 6.448 | 6.428 | 6.566 | 6.523 |
| 2. Low temperature viscosity cSt (−40° C.) | 1640 | 1720 | 1390 | 1910 | 1780 | 1800 | 1960 |
| 3. Flash point (°C.) | 160 | 161 | 144 | 151 | 152 | 146 | 142 |
| 4. Initial boiling point (°C.) | 285 | 285 | 256 | 270 | 270 | 260 | 245 |
| 5. Aniline point (°C.) | 93.0 | 93.8 | 83.3 | 84.3 | 83.1 | 86.0 | 94.1 |
| 6. Evaporation loss (wt. %) | 1.0 | 1.0 | 4.7 | 3.1 | 3.4 | 3.0 | 12.0 |

TABLE 2

| Comparative Example | 1 | 2 | 3 | 4 | 5 | 6 |
|---|---|---|---|---|---|---|
| (1) Hydrocarbon base oil | | | | | | |
| (a) Oligomer of 1-decene | | | | A(20) | A(20) | A(70) |
| (b) Petroleum-type lubricating oil fraction | B(100) | C(100) | | B(80) | C(80) | |
| (c) Polybutene | | | D(100) | | | D(30) |
| (2) Viscosity index improver | | | | | | |
| Polymethacrylate | E(12.0) | E(15.0) | E(18.4) | E(11.0) | E(15.0) | E(17.5) |
| (3) Additive | | | | | | |
| Antioxidant | F(0.5) | F(0.5) | G(0.9) | F(0.3) | F(0.3) | F(0.3) |
| Abrasion resisting agent | H(2.0) | H(2.0) | | H(3.0) | H(3.0) | H(3.0) |
| Oiling agent | I(1.5) | I(1.5) | | I(2.0) | I(2.0) | I(2.0) |
| Cleansing dispersant | | | N(2.1) | | | |
| Antifoamer | P(0.05) | P(0.05) | Q(0.1) | P(0.05) | P(0.05) | P(0.05) |
| Test results | | | | | | |
| 1. Viscosity cSt (100° C.) | 7.424 | 6.889 | 7.75 | 6.414 | 6.854 | 6.949 |
| 2. Low temperature viscosity cSt (−40° C.) | 9280 | 2490 | 1900 | 3630 | 2090 | 1200 |
| 3. Flash point (°C.) | 173 | 140 | 118 | 164 | 142 | 136 |
| 4. Initial boiling point (°C.) | 276 | 270 | 226 | 290 | 258 | 234 |
| 5. Aniline point (°C.) | 95.0 | 65 | 81.0 | 93.2 | 74.6 | 93.0 |
| 6. Evaporation loss (wt. %) | 1.0 | 13 | 40.0 | 0.5 | 10.0 | 18.5 |

What we claim is:

1. A central system fluid composition consisting essentially of (1) 70 to 95% by weight of a hydrocarbon base oil and (2) 5 to 30% by weight of a viscosity index improver, wherein said hydrocarbon base oil (1) contains (a) 25% by weight to less than 50% by weight, based on the weight of the hydrocarbon base oil (1), of a dimer of 1-decene and (b) more than 50% by weight to 75% by weight of a petroleum lubricating oil fraction, and said viscosity index improver (2) is a polymethacrylate having a viscosity average molecular weight of 10,000 to 700,000 obtained by polymerizing at least one ester of a saturated monohydric aliphatic alcohol having 1 to 18 carbon atoms with methacrylic acid, and (3) with or without a conventional additive.

2. The fluid composition of claim 1 wherein said hydrocarbon base oil (1) further contains (c) polybutene having an average molecular weight of 100 to 500.

3. The fluid composition of claim 2 wherein based on the weight of the hydrocarbon base oil (1), the proportion of the component (a) is at least 25% by weight but below 50% by weight, the proportion of the component (b) is more than 50% by weight to 75% by weight, and the proportion of the component (c) is not more than 20% by weight.

4. The fluid composition of claim 1 which contains (3) a conventional additive.

5. The fluid composition of claim 4 wherein said additive (3) is at least one additive selected from the group consisting of antioxidants, oiling agents, abrasion resisting agents, cleansing dispersants, antifoamers and metal inactivating agents.

6. The fluid composition of claim 4 or 5 wherein the amount of the additive (3) is 0.1 to 10% by weight based on the weight of the fluid composition.

* * * * *